US007002126B2

(12) United States Patent
Gnemmi et al.

(10) Patent No.: US 7,002,126 B2
(45) Date of Patent: Feb. 21, 2006

(54) PROJECTILE STEERING BY PLASMA DISCHARGE

(75) Inventors: Patrick Gnemmi, Saint-Louis (FR); Romain Charon, Michelbach-le-bas (FR); Michel Samirant, Saint-Louis (FR)

(73) Assignee: Institut Franco-Allemand de Recherches de Saint-Louis, Saint-Louis (FR)

( * ) Notice: Subject to any disclaimer, the term of this patent is extended or adjusted under 35 U.S.C. 154(b) by 13 days.

(21) Appl. No.: 10/686,734

(22) Filed: Oct. 17, 2003

(65) Prior Publication Data

US 2005/0017124 A1 Jan. 27, 2005

(30) Foreign Application Priority Data

Oct. 17, 2002 (FR) ..... 02 12906

(51) Int. Cl.
*F41G 7/00* (2006.01)
*F41G 9/00* (2006.01)
*H02K 44/00* (2006.01)

(52) U.S. Cl. ..... 244/3.1; 310/10; 310/11; 60/200.1; 60/202; 60/203.1; 313/231.01; 313/231.31

(58) Field of Classification Search ..... 244/3.1–3.3; 60/200.1, 202, 203.1; 310/11, 10; 313/231.01, 313/231.31, 231.41, 231.51, 231.61; 417/48–51
See application file for complete search history.

(56) References Cited

U.S. PATENT DOCUMENTS

| | | | | |
|---|---|---|---|---|
| 3,151,259 | A * | 9/1964 | Gloersen et al. | 310/11 |
| 3,176,227 | A * | 3/1965 | Bender | 244/3.21 |
| 3,210,926 | A * | 10/1965 | Forbes et al. | 60/202 |
| 4,109,883 | A * | 8/1978 | Korr et al. | 244/3.1 |
| 4,370,716 | A * | 1/1983 | Amieux | 244/3.22 |
| 5,273,237 | A | 12/1993 | Guyton et al. | |
| 5,349,532 | A * | 9/1994 | Tilley et al. | 244/3.21 |
| 6,145,298 | A * | 11/2000 | Burton, Jr. | 60/202 |
| 6,205,378 | B1 * | 3/2001 | Rodden et al. | 244/3.21 |
| 6,367,735 | B1 * | 4/2002 | Folsom et al. | 244/3.22 |
| 6,530,212 | B1 * | 3/2003 | Phipps et al. | 60/203.1 |

FOREIGN PATENT DOCUMENTS

| | | |
|---|---|---|
| DE | 10 22 913 B | 1/1958 |
| DE | 1 0 22 913 | 1/1965 |
| DE | 38 04 931 A1 | 8/1989 |
| FR | 2 686 409 | 7/1993 |
| FR | 2 686 409 A | 7/1993 |
| GB | 1 181 431 A | 2/1970 |
| WO | WO 97/37126 | 10/1997 |
| WO | WO 02/14781 A1 | 2/2002 |
| WO | WO 02 14781 A1 | 2/2002 |

* cited by examiner

*Primary Examiner*—Bernarr E. Gregory
(74) *Attorney, Agent, or Firm*—Oliff & Berridge, PLC

(57) ABSTRACT

A device and method for guiding or steering projectiles (self-propelled or non-self-propelled), or missiles, and for steering a supersonic projectile, or a missile, having a nose, generally in the shape of a cone, having a more or less pointed end, and capable of creating a plasma discharge near the end of the projectile over a limited sector of the outer surface of nose.

8 Claims, 3 Drawing Sheets

PROJECTILE STEERING BY PLASMA DISCHARGE

BACKGROUND OF THE INVENTION

The invention relates in particular to the domain of arrangements for guiding or steering projectiles (self-propelled or non-self-propelled), or missiles, and relates to a method and associated device for steering a projectile, such as, for example, a shell, a bullet, or a missile.

A craft flying in the atmosphere can be steered, in particular, by deployment of airfoils or by operation of a pyrotechnic device, for example.

The main drawback of airfoils lies in their deployment, which involves considerable force that increases proportionally with the speed of the craft, and resistance of the device to the very high pressures encountered at supersonic speeds. Moreover, this type of steering requires a long reaction time which may be a major drawback if the craft is spin-stabilized. The main drawback in steering a flying craft by the operation of a pyrotechnic device is that the pyrotechnic device can operate only once.

SUMMARY OF THE INVENTION

A goal of the invention is to overcome these drawbacks by providing a method for steering a supersonic projectile or a missile, i.e. one whose speed is greater than that of sound, has no moving parts, and can be operated as many times as necessary.

The solution is a method for steering a supersonic projectile or a missile, having a nose, generally cone-shaped, that has a more or less pointed end, and is characterized by discharging plasma in the vicinity of the end over a limited sector of the outer surface of the nose.

According to one specific feature, the invention relates to a method for steering, in a direction Y, a supersonic projectile or a missile, having a nose, generally cone-shaped, that has a more or less pointed end, characterized by discharging plasma in the vicinity of the end over a limited sector of the outer surface of the nose and on the side of direction Y.

The invention also relates to a device for steering a supersonic projectile or a missile, having a nose, generally cone-shaped, that has a more or less pointed end, and characterized by having means for emitting a plasma discharge in the vicinity of the end over a limited sector of the outer surface of the nose.

According to one particular feature, the means for emitting a plasma discharge comprises a triggered spark-gap, two electrodes, and a high-voltage generator.

According to another feature, the means include at least one pair of electrodes. Indeed, the means include at least one pair of electrodes if the projectile is spinning or several pairs of electrodes if it is not spinning.

BRIEF DESCRIPTION OF THE DRAWINGS

Other advantages and characteristics will appear in the description of particular embodiments of the invention with reference to the attached drawings, wherein.

DETAILED DESCRIPTION OF PREFERRED EMBODIMENTS

In the case of a supersonic craft, a shock wave is produced upstream of its nose. When the craft is flying on a straight trajectory, the pressures distributed over its surface are balanced and the shock wave has symmetries according to the shape of the craft. In the case of a projectile having a conical nose, the wave is attached to the tip of the cone and is conical.

Figure 1:
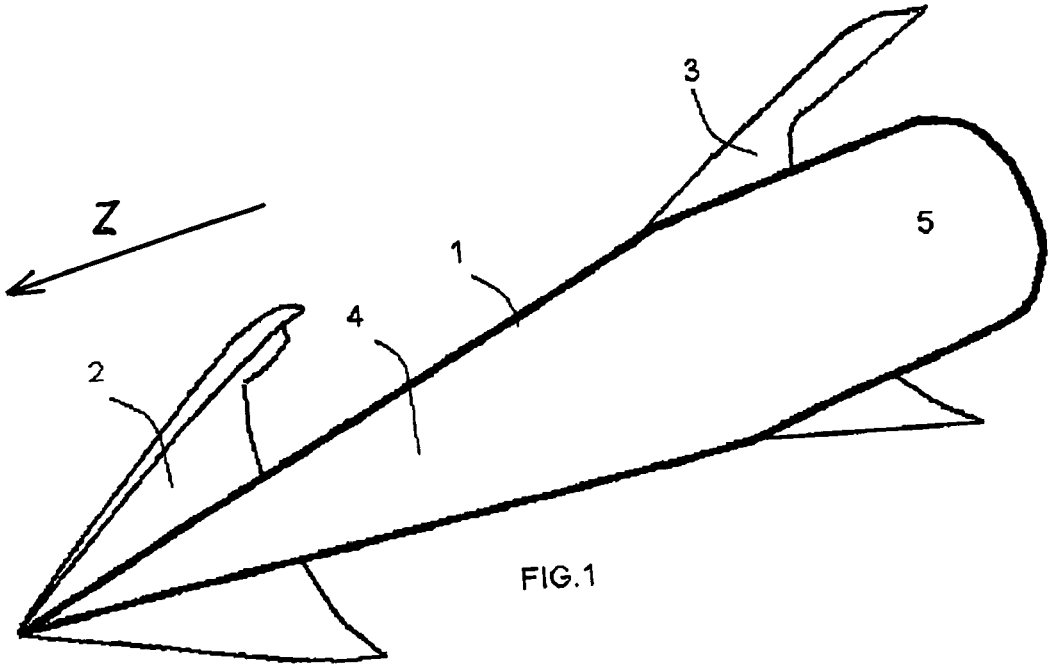
FIG. 1 is a diagram of the shock waves generated by a supersonic projectile.

FIG. 1 shows the results of a digital simulation of a craft flying at supersonic speed in the direction of the arrow Z. It shows integrally a craft 1 and half of two other surfaces 2, 3. The craft has a conical front part 4 and a cylindrical rear part 5. The surfaces 2, 3 characterize a constant pressure in the flow. Surface 2, attached to the tip of the craft, represents the surface of a conical shock wave whereas surface 3, attached to the discontinuity in the craft surface (where the cone meets the cylinder), represents an expansion wave.

The invention, applied to such a projectile, comprises unbalancing the flow around the nose of the craft and producing a plasma discharge near the end of the nose very close to the tip to effect a course correction. The plasma discharge produced over a limited angular sector modifies the boundary layer surrounding the surface of the craft. Hence the objective is to produce a discharge such that the imbalance in thermodynamic magnitudes is large enough to cause the craft to deviate from its straight-line trajectory.

The absence of moving parts and the repetitiveness of the discharges are the main advantages of this technique. Thus, the trajectory of the craft can be controlled by repeated discharges actuated on demand according to the desired trajectory.

Figure 2:
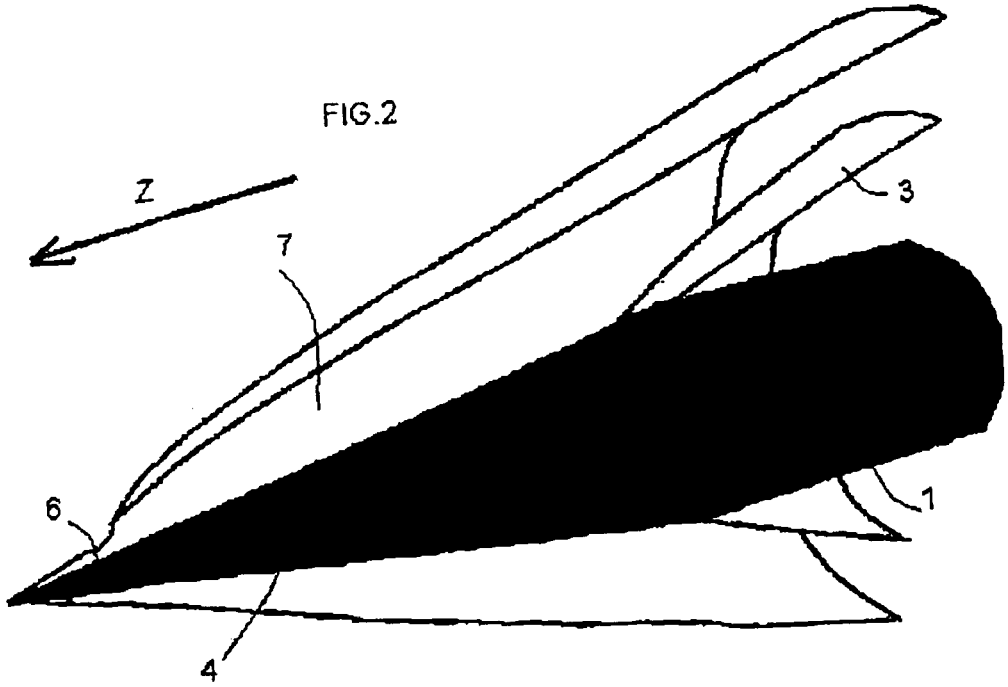
FIG. 2 shows the result of a digital simulation of the same craft flying under the same conditions of supersonic flight as before, to which a plasma discharge is applied.

FIG. 2 shows the results of a digital simulation of the same craft flying under the same supersonic flight conditions as before, to which a plasma discharge is applied near the tip. Each of the two surfaces 7, 3 represented in this figure characterizes a constant pressure in the flow. It can be seen that, at the tip of craft 1, the shock wave 7 deviates under the action of the plasma discharge 6.

Figure 3:
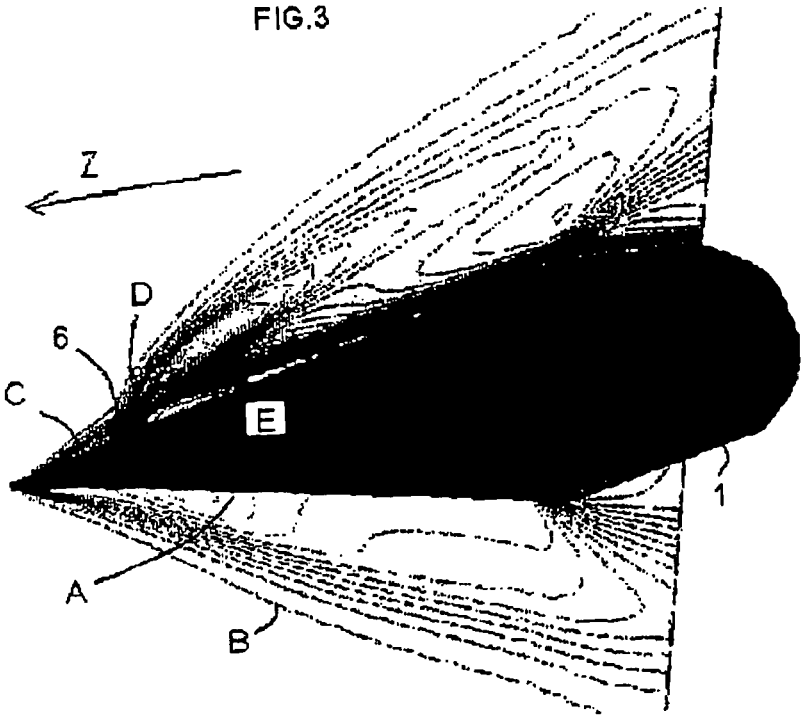
FIG. 3 shows the dissymmetry of the density distribution of the air surrounding half the projectile surface, in the plane of symmetry of the flow for the example chosen.

FIG. 3 shows the dissymmetry in density distribution of the air surrounding half the projectile surface, in the plane of symmetry of the flow for the example chosen. This density is largely constant and equal to 1 $kg/m^3$ between points A, B located opposite the plasma discharge 6 and downstream, relative to direction Z of the projectile, of the plasma discharge (zone C), while it is very low (approximately $2.710^{-2}$ $kg/m^3$) at the skin E of the projectile upstream of plasma discharge 6. On the other hand, it peaks at about 3 $kg/m^3$ at point D where the plasma discharge 6 is located.

Figure 4:
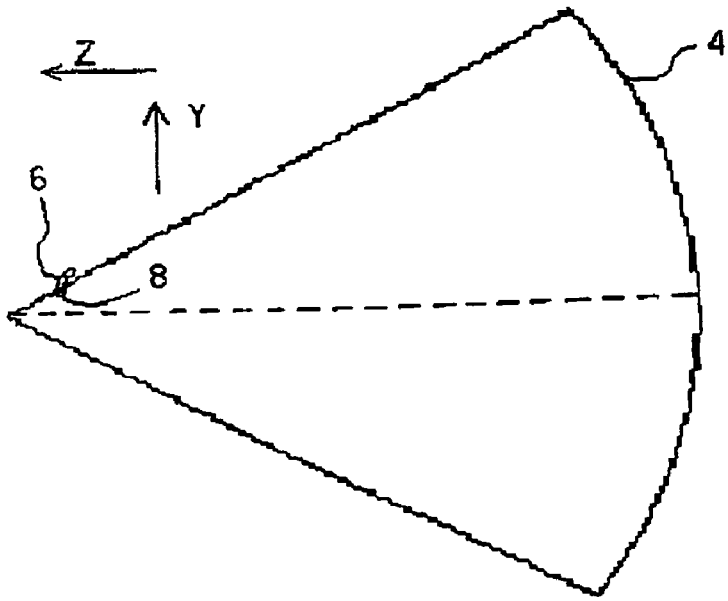
FIG. 4 is a diagram of a device according to one embodiment of the invention.

FIG. 4 shows part of the device according to one embodiment of the invention. This part has a nose 4 in the shape of a cone of a supersonic projectile. Near the end of the nose is a plasma discharge 6.

To deviate the projectile in a direction Y that is perpendicular thereto, a plasma discharge 6 is produced over a limited sector 8 of the outer surface of the nose on the side of direction Y.

Figure 5:
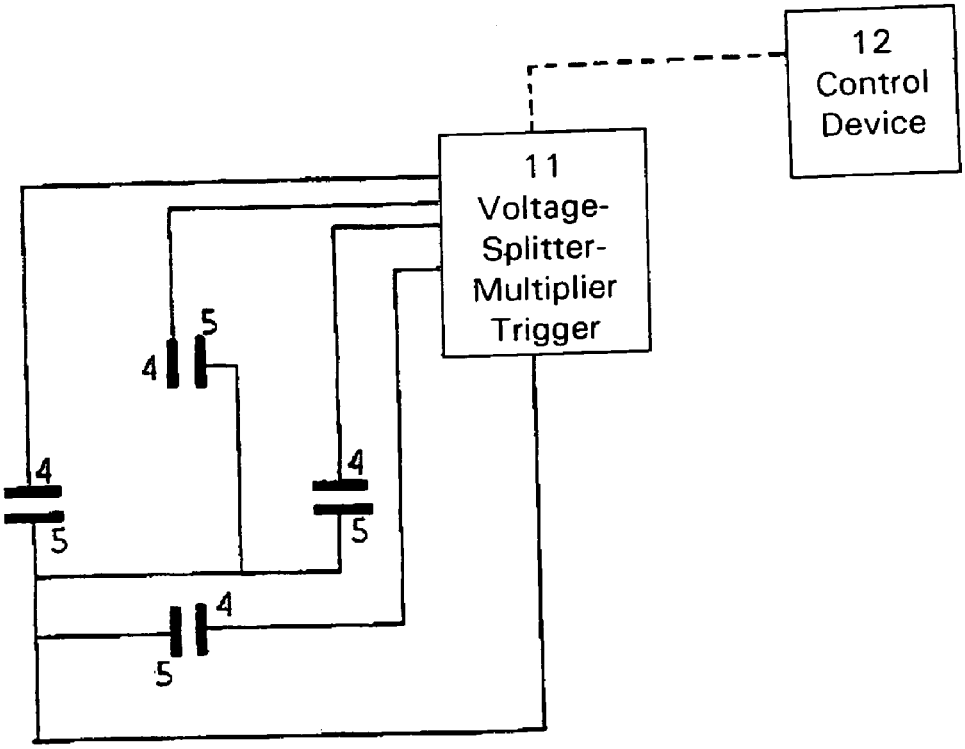
FIG. 5 shows one example of the layout of four pairs of electrodes disposed $\pi/2$ radians apart.

FIG. 5 shows one sample layout of four electrode pairs disposed $\pi/2$ radians apart near the end of the projectile nose. The electrodes are connected to a circuit able to generate an energy between the electrodes of which the pairs are composed, that is sufficient to trigger the plasma. This circuit has a control device 12 and a voltage-splitter-multiplier trigger 11.

Thus, the control device 12, via splitter-multiplier trigger 11, initiates the generation of the appropriate voltage differential and delivery of the voltage generated to the pair(s) corresponding to the desired deviation.

The drag of the craft and the steering force and moment can be determined by calculation. Even when these forces are small, the device is of interest because it acts near the tip of the craft so that a small flow dissymmetry destabilizes the projectile, enabling it to be steered. Using the same device, or another device according to the invention located at another point on the projectile, may restabilize the projectile on its trajectory.

Also, this device may be associated with control means, for example a GPS system, a homing system, a remote-control system, or any other system for detecting the roll position.

As an example, for a 20 mm caliber projectile flying at ground level under normal conditions at a speed of Mach 3.2, the front part of which is composed of a cone with a vertex angle of 20° and a cylindrical part having no airfoil, a plasma discharge with a temperature of approximately 15,000 K is produced over a surface area of 9 $mm^2$ near the projectile tip requiring a momentum drag corresponding to a mass flow of an explosible substance of approximately $15\times10^{-4}$ kg/s corresponding to a power of approximately 3 kVA. The duration of the discharge, between 2 and 4 ms, corresponds to an electrical energy of approximately ten Joules.

The discharge intensity may be modulated by adjusting the thermodynamic parameters, such as discharge temperature and associated momentum drag.

The plasma is generated by high-voltage discharge(s). This/these discharge(s) is/are obtained by a voltage-multiplier trigger which, upon receipt of a low-level electrical or optical signal, delivers sufficient energy to trigger the plasma. The design enables the electrical energy, stored before the voltage pulse appropriate for the plasma discharge conditions is initiated, to be optimized.

The impact on aerodynamic effects is interesting. The aerodynamic effects are first assessed by digital simulation in the case of a non-guided projectile flying on a straight trajectory with a zero angle of attack. The aerodynamic coefficients are calculated only for the forward part of the projectile so that the wake is not taken into account.

The drag coefficient is Cx=0.1157. The lift coefficient Cz and the moment coefficient Cm calculated at the projectile tip are of course zero. The aerodynamic coefficients are now determined for the projectile flying on a straight trajectory at zero angle of attack and guided by plasma discharge modeled under the conditions stated above.

The drag coefficient is Cx=0.0949. The lift coefficient is Cz=0.0268 corresponding to a force of 6 N oriented in the direction in which the discharge acts. The moment coefficient calculated at the projectile tip is Cm=0.0356, corresponding to a moment of 0.1609 mN oriented such as to accompany the effects of the lift force.

Analysis of the results of this simulation shows:

a reduction in the drag of the projectile at the time of the plasma discharge of approximately 18%, which is very large;

that the steering force acts in the direction of the discharge;

that the pitch moment contributes beneficially to the steering force to make the projectile manageable.

Of course, numerous modifications may be made without departing from the scope of the invention. Thus, the nose may have any shape and not necessarily revolve.

What is claimed is:

1. A method for steering, in a direction Y, a supersonic projectile or a missile having a generally cone-shaped nose, that has a substantially pointed end, comprising discharging plasma over a limited sector of the outer surface of the nose on the side of direction Y.

2. The method according to claim 1, comprising creating a plasma discharge proximate the end, over a limited sector of the outer surface of the nose and on the side of direction Y.

3. A method for steering a supersonic projectile or a missile having a nose, generally cone-shaped, that has a substantially pointed end, comprising, for each change in the trajectory of the projectile or the missile, discharging plasma proximate the end over a limited sector of the outer surface of the nose on a side corresponding to a direction toward which the trajectory is to be changed.

4. The steering method according to claim 3, comprising producing plasma discharges, for each change in the trajectory of the projectile or the missile, proximate the end and over a limited sector of the outer surface of the nose.

5. A device for steering a supersonic projectile or a missile having a nose, generally cone-shaped, that has a substantially pointed end, comprising means for emitting a plasma discharge proximate the end over a limited sector of the outer surface of the nose on a side of the nose toward which direction the projectile or the missile is to be steered.

6. The device according to claim 5, wherein the means for emitting a plasma discharge comprise a triggered spark-gap, two electrodes, and a high-voltage generator.

7. The device according to claim 5, wherein the means include at least one pair of electrodes.

8. The device according to claim 6, wherein the means include at least one pair of electrodes.

* * * * *